US007135968B2

(12) United States Patent
Hosny

(10) Patent No.: US 7,135,968 B2
(45) Date of Patent: Nov. 14, 2006

(54) DIGITAL ALERTING SECURITY UNIT

(75) Inventor: Diaa Hosny, Redondo Beach, CA (US)

(73) Assignee: Wireless Tec, Palos Verdes Estates, CA (US)

( * ) Notice: Subject to any disclaimer, the term of this patent is extended or adjusted under 35 U.S.C. 154(b) by 333 days.

(21) Appl. No.: 10/371,828

(22) Filed: Feb. 20, 2003

(65) Prior Publication Data

US 2004/0164860 A1 Aug. 26, 2004

(51) Int. Cl.
*G08B 1/08* (2006.01)

(52) U.S. Cl. ..... 340/539.32; 340/539.11; 340/573.1

(58) Field of Classification Search ..... 340/539.32, 340/539.11, 539.13, 539.15, 573.1, 571, 572.1
See application file for complete search history.

(56) References Cited

U.S. PATENT DOCUMENTS 5,396,218 A * 3/1995 Olah ..... 340/568.7
5,552,773 A * 9/1996 Kuhnert ..... 340/573.1
5,640,144 A 6/1997 Russo et al.
5,939,981 A * 8/1999 Renney ..... 340/539.32
5,963,131 A * 10/1999 D'Angelo et al. ..... 340/568.1
6,040,772 A 3/2000 Jackson et al.
6,724,306 B1 * 4/2004 Parsley et al. ..... 340/568.1

* cited by examiner

*Primary Examiner*—Toan Pham

(57) ABSTRACT

A digital alerting security system and a method to signal audio and/or visual alarms and to communicate alerts through telecommunication link and/or electronic messaging that a person has forgotten or separated a predetermined distance from a valuable item/object/animal is disclosed. The system and the method also act as a smart tag to secure that travelers are accompanying their checked luggage/objects on board and to quickly identify luggage that does not belong to identified travelers on board or to facilitate their luggage retrieving afterwards by signaling and communicating alerts. The system comprises a single or multi-dimensional ultrasonic transmitter and alerting means, which is attached or integrated to the item/luggage/object/animal, with modulating and digital coding means; and a portable receiver/alerting means with demodulation and digital decoding means. Each of these means can be energized with the of aid a single pole one way switch and a power supply mean. The receiver/alerting means can automatically reset itself when the item/object/luggage/animal is secured.

20 Claims, 7 Drawing Sheets

DIGITAL ALERTING SECURITY UNIT

BACKGROUND OF THE INVENTION

Many people leave behind items/objects/animals/persons when travelling in a public transport, visiting a friend, eating out in a restaurant . . . etc. This invention describes a device which acts as an alerting means to remind a person that an object/item/animal/person has been left behind or separated a pre-set, specified distance from the object/item/animal/person, thus stopping people wasting a great deal of time, effort and money trying to locate and retrieve missing objects/items/animals/persons and in many times they may lose them forever. The unit also can be used to secure that traveller is accompanying his checked luggage/objects and to quickly identify luggage that does not belong to travellers on board by sounding audio and/or visual alerting means.

(1) Field of the Invention

This invention alerts or reminds a person for forgotten or left behind or separated a pre-set, specified distance from an objects/items/animals/persons. The unit can be used to secure that traveller is accompanying his checked luggage/objects and to quickly identify luggage that does not belong to travellers on board by sounding audio and/or visual alerting means.

It offers simplicity in structure and use. It gives an alerting means (audio and/or visual) as a reminder for the person to go back and retrieve these objects/items/animals/persons.

The invention offers the following advantages: It is based on a simple two way communication system, it contains simple and inexpensive parts, it is small in size, both of the transmitter and receiver units can be respectively attached or clipped to the object/item/animal and the person. The alerting device is user friendly and offers a very straightforward but effective alerting means.

(2) Description of the Prior Art

U.S. Pat. No. 5,640,144 by Russo et al., 1997, describes an alarm system for preventing of loss or theft of one or more articles. This invention suffers from the following limitations: In addition to the ultrasonic communication channel, it requires RF communication channels for coding purposes thus leading to the necessity of an RF antenna both in the monitoring unit carried or attached to a person and the protection unit attached to an article which can have implications as far the size compactness of the apparatus is concerned, it requires two RF communication channels for space diversity for better reception but even with this facility there is no guarantee that the apparatus can monitor articles in all spatial directions and the apparatus requires a sophisticated control logic unit for triggering the alarm unit when the distance between the monitoring and the protection unit attached to an article exceeds a predetermined value.

U.S. Pat. No. 6,040,772 by Jackson et al, 2000, describes an alarm system for forgotten golf clubs. It comprises a radio transmitter for transmitting a coded signal, which is attached to a divot tool and a radio receiver for receiving the transmitted coded signal which is carried by the golfer, an alarm signal is generated whenever power associated with the coded transmission drops below a prescribed threshold level. This invention has the following shortcomings: It requires an RF antenna both in the receiver and in the transmitter which can have implications as far as size compactness of the system is concerned, the type and specification of the antenna in order to receive signals in all directions is not included, it requires a sophisticated microcontroller both in the transmitter and the receiver electronics, it is only suitable for long range alarm (as it is stated it is typically 50 yards) because the alarm included in the receiver unit is triggered when there is a noticeable drop in the power associated with the coded transmission hence this implies that the system is not suitable for short range applications (in the order of one or two yards) as there would not be enough drop in the power associated with the coded transmitted signal in order to trigger the alarm.

The present invention offers an uncomplicated design and construction, small size, no antenna is required in both of the transmitter unit and the receiver/reminder unit as it does not need an RF communication channel. In addition the apparatus is based on a simple omnidirectonal ultrasonic acoustic or air pressure waves communication channel which is capable of monitoring objects/items/animals/persons in all directions and alerting a person if they are forgotten or left behind whilst scanning them in all directions (360° spatial angular displacement). Moreover, the apparatus uses frequency shift keying (FSK) communication system for using plurality of such apparatuses in the field, the reminder unit offers audio alerting means (buzzers, audio messages or music) and/or visual means such as flashing display unit.

The scope of this invention should be determined by the appended claims and their legal equivalent than solely by the examples given.

SUMMARY

An electronic alerting/alarm unit intending to give audio or visual alerting as a reminder that something has been forgotten, left behind or separated a pre-set, specified distance is described. The unit can be used to secure that traveller is accompanying his checked luggage/objects and to quickly identify luggage that does not belong to travellers on board by sounding audio and/or visual alerting means. The unit comprises a portable short-range ultrasonic transmitter, which is attached or clipped to the object/item/animal, which can be forgotten or left behind by a person, a portable integrated ultrasonic receiver and reminder unit, which is held by the person. Each of these units can be energised with the aid of a single pole one way switch and a power supply means.

DETAILED DESCRIPTION OF THE PREFERRED EMBODIMENTS

Figure 4:
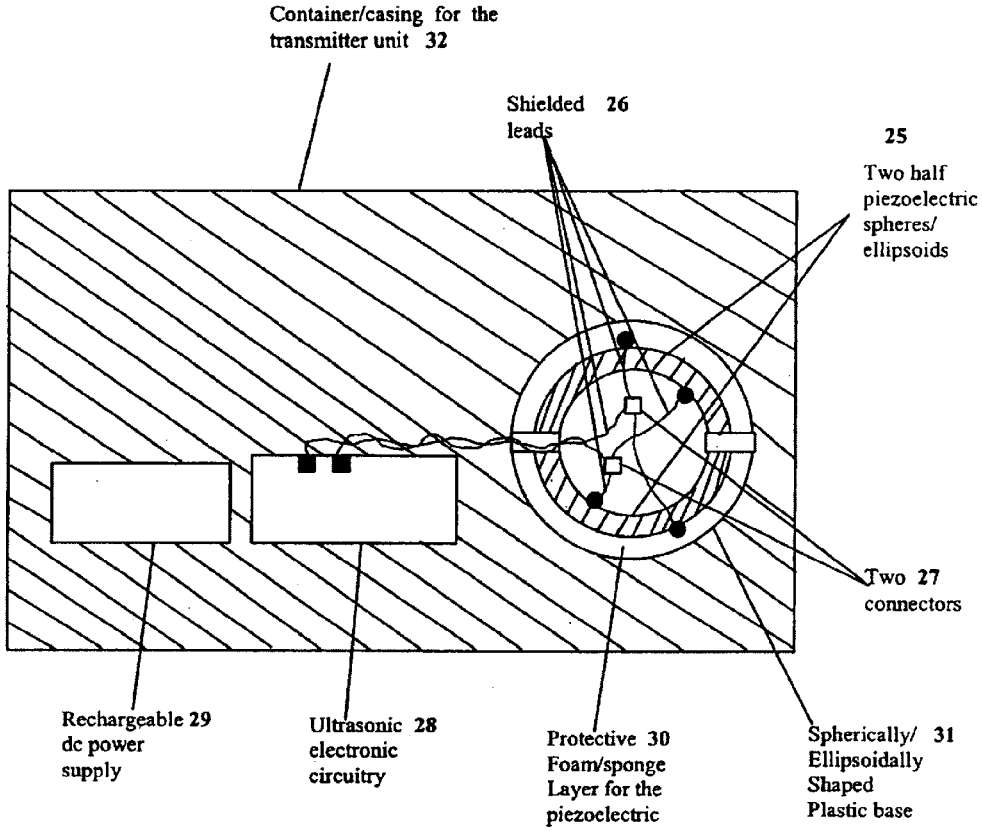
FIG. 4 shows the details of the transmitter which could be made of piezoelectric material or any other suitable material and energized in response to a sensor/s or signals to start transmitting a specified digital code or codes. It consists of two-half spheres/ellipsoids (50) placed in a housing to leave a small gap in the middle. The gap provides a route for shielded leads (52) which are connected/soldered, using two connectors (54) to suitable locations on the external and internal surfaces of the two half spheres/ellipsoids. Two other leads are used to connect the two connectors (54) to the transmitter electronics means (56). The latter is supplied from the power supply means (58). The transmitter is surrounded by a protective foam/sponge layer (60) which should not restrict the spherically shaped transmitter from pulsating or vibrating when the transmitter signal is applied from the electronics means (56). This protective layer is housed in a spherically/ellipsoidally shaped plastic base (62). All the building blocks of the transmitter circuits which are shown in FIG. 1 and the transmitter itself as well as the power supply means are all housed in a suitable non-conducting enclosure/housing casing (64).
Figure 5:
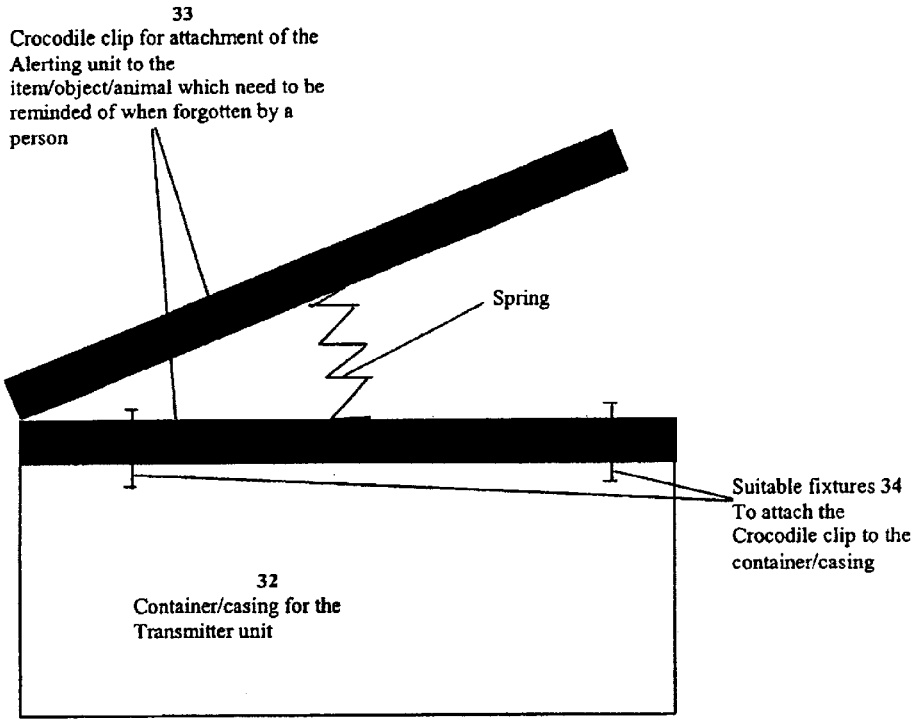
FIG. 5 shows the enclosure/casing (64) with a crocodile clip (66) attached to it. The function of the latter is to make it possible to the transmitter means to be attached or clipped to an object/item/animal which a person needs to be reminded of when forgotten or left behind by a person. The crocodile clip is fixed to the enclosure/housing casing (64) by means of a suitable insulated fixture (68).

This invention gives a person an alerting or reminding facility that he/she has forgotten an object/item/animal behind anywhere via triggering buzzer/audio message/music/song and/or flashing display means when the person is away from the object/item/animal within a specified short-range and it resets itself when the person, having been reminded, goes back to retrieve the object/item/animal. It consists of a transmitter unit, which includes the building blocks in FIG. 1, and an integrated receiver/reminder unit, which includes the building blocks shown in FIG. 2. The circuit diagram of the reminder means (block number 24 in FIG. 2) is given in FIG. 3. FIG. 4 shows the details of the piezoelectric ultrasonic transmitter. FIG. 5 shows a possible housing/container/casing for each of the transmitter unit and the integrated receiver/reminder unit. The transmitter unit is attached or clipped to an object/item/animal, which can be forgotten or left behind. The integrated receiver/reminder unit is carried by or clipped to a person who may forget behind the object/item/animal/person in a public place, public transport or whilst visiting acquaintances in their homes or offices. Each of the transmitter unit and the integrated receiver/reminder unit is energized with the aid of a single way single pole switch and a power supply means. These are not shown in FIGS. 1 and 2 since these two figures are block diagrams not circuit diagram but since FIG. 3 is a circuit diagram it shows the power supply means (26).

Figure 1:
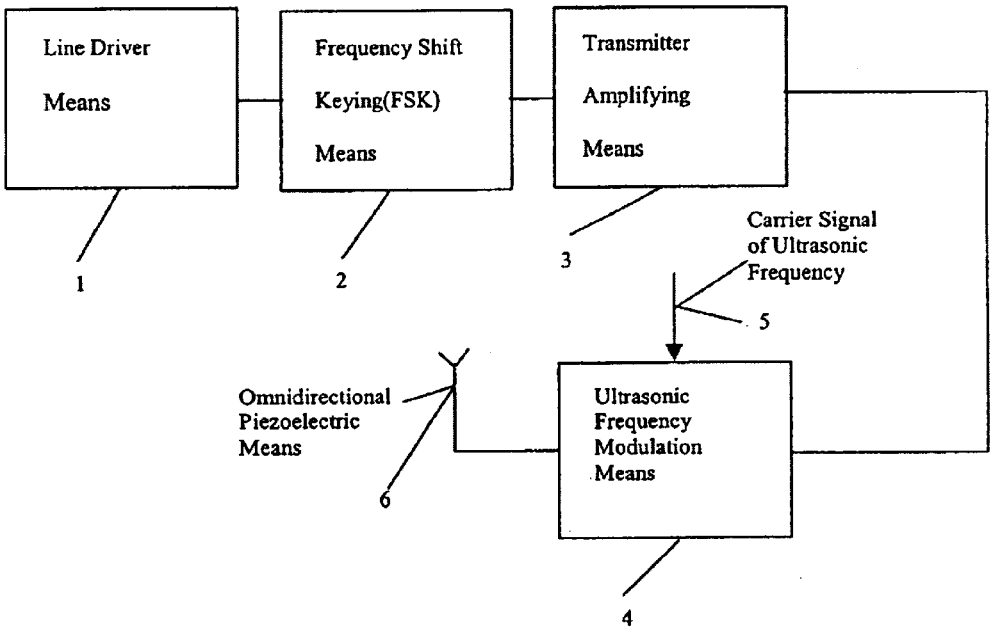
FIG. 1 shows a block diagram of the transmitter unit building blocks. It encompasses a line driver means (2) which generates the address/digitally coded signal to be transmitted, the frequency shift keying (FSK) means (4), the transmitter amplifying means (6), the ultrasonic frequency modulation means (8) where a carrier signal of ultrasonic frequency (10) is modulated with the address/digitally coded signal before transmission, an omnidirectional piezoelectric means (12) for transmission of the ultrasonic signal in the form of ultrasonic waves. The transmitter unit will be attached or clipped to the object/item/animal, which a person needs reminding of when it is forgotten or left behind.
Figure 2:
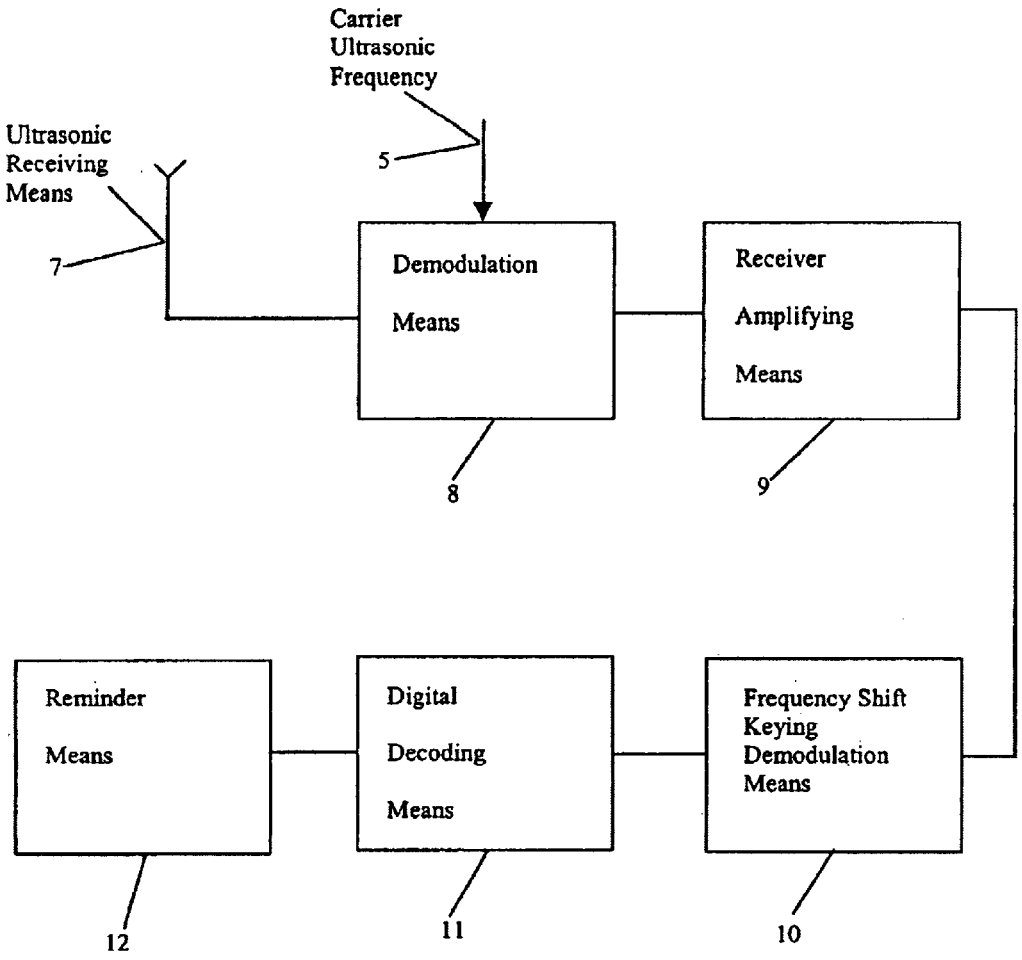
FIG. 2 shows a block diagram of the integrated receiver and reminder unit building blocks. It encompasses an ultrasonic receiving means (14) which picks up the transmitted ultrasonic vibrations or the sound waves, the demodulation means (16) which is fed by the carrier ultrasonic frequency (10), the receiver amplifying means (18), the frequency shift keying (SFK) demodulation means (20), the digital decoding means (22) which decodes the received digital signal to generates an enable signal to the reminder means (24) which generates an audio message or visual display when the object/item/animal to which the transmitter is attached is out of sight from the receiver within a certain defined short range. This unit is held by the person who is to be reminded when he/she has forgotten or left behind an object/item or animal.

In the transmitter unit, FIG. 1, the line driver means (2) generates a unique encoded digital signal which is to be transmitted. The number of bits in this digital signal determines the number of possible unique encoded signals. This signal is fed to the frequency shift keying (FSK) means (4) which modulates the signal such that a logic 1 in this signal is represented by an audio frequency of any frequency between 200–3100 Hz and logic 0 is represented by an audio signal within the same range but of a different frequency value. A transmitter amplifying means (6) is needed. The bandwidth of the amplifier is about 3.1 kHz. A level of amplifier output power of about 200 mwatts is needed for a short-range transmission of about 2 meters. The output signal from the amplifier is fed to the ultrasonic frequency modulating means (a mixer circuit)(8) with an ultrasonic carrier frequency of about 20–40 kHz. The output of the mixer circuit is connected to the omnidirectional piezoelectric means (12). The latter is shown in some detail in FIG. (4) in conjunction with the transmitter unit electronics housing (56) and the power supply means housing (58). As it can be seen in FIG. 4, the piezoelectric omnidirectional transmitter consists of two half-piezoelectric spheres/ellipsoids (50) placed in a housing to leave a small gap in the middle. The gap provides a route for shielded leads (52) to be connected/soldered, using two connectors (54) to suitable locations on the external and internal surfaces of the two piezoelectric half spheres/ellipsoids Two other leads are used to connect the two connectors (54) to the transmitter unit electronics (56). The latter is supplied from the power supply means (58). In order to provide protection for the piezoelectric transmitter, it is surrounded by a foam/sponge layer (60), which should not restrict the piezoelectric spherically shaped transmitter from pulsating or vibrating when the transmission signal is applied from the transmitter unit electronics (56). This protective foam/sponge layer is housed is a spherically/ellipsoidal shaped plastic base (62). As shown in FIG. 5, it is possible to house all the building blocks of the transmitter unit shown in FIG. 1 in a suitable nonconducting enclosure/housing/casing (64) which has a crocodile clip (66) attached to it in order to make it possible for the transmitter unit to be attached or clipped to an object/item/animal which needs to be reminded of when forgotten or left behind by a person. The crocodile clip is fixed to the transmitter enclosure/housing/casing using suitable insulated fixture (68).

Figure 3:
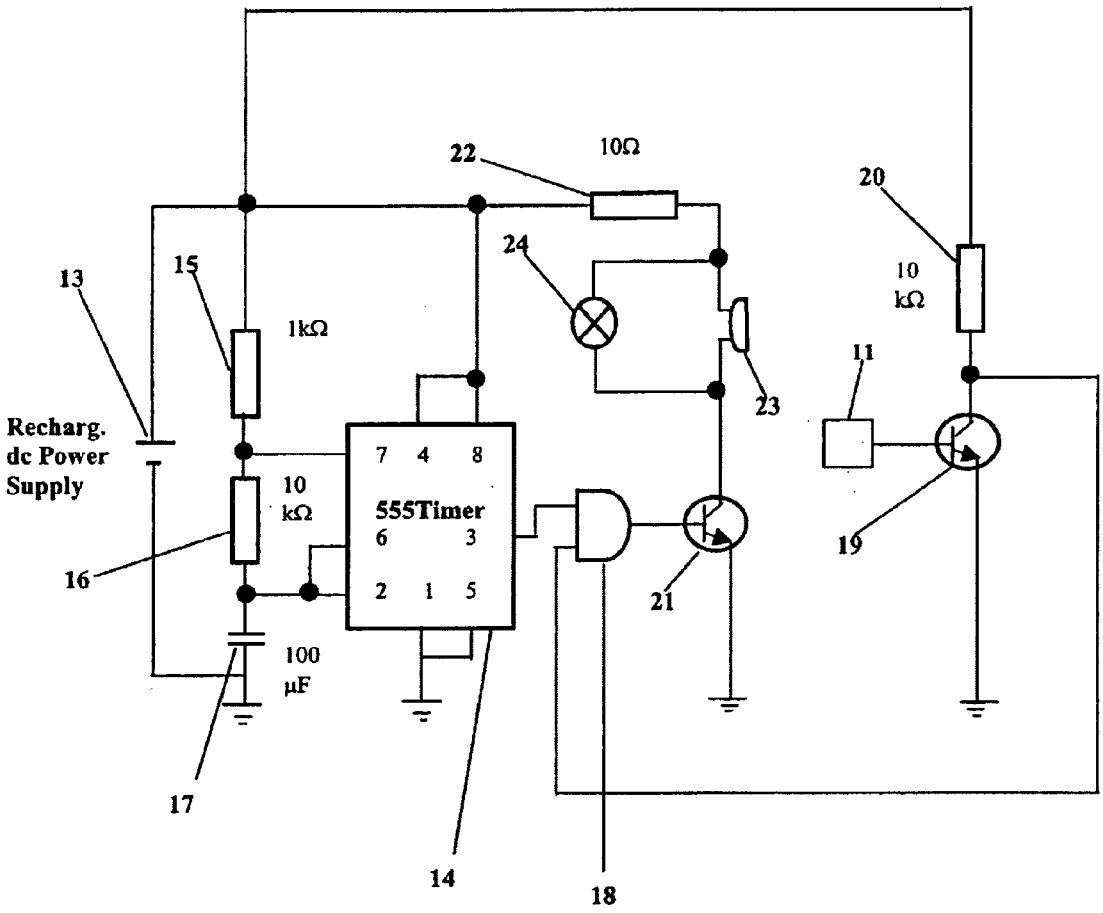
FIG. 3 shows a circuit diagram detailing the reminder means (24). It comprises the following components: power supply means (26), An astable multivibrator 555 timer (28), external components to the 555 timer (30), (32), (34) in order to enable the timer to generate pulses at a few cycles per second (Hz) frequency. The output from the 555-timer (28) is fed to one of the inputs of a bi-inputs AND logic gate (36). The other input of the AND logic gate is connected to the collector of a NPN transistor (38). The base of this transistor is fed from the digital decoding means (22) in the receiver unit described above. As long as the object/item/animal, to which the transmitter unit described earlier is attached, is seen by the receiver unit, transistor (38) is switched on as it receives a base current from the digital decoding unit (22). Thus, its collector is pulled down to the ground voltage level. Hence, the AND logic gate is disabled. When the object/item/animal is out of sight within a specified short range, transistor (38) switches off, as it will not receive a base current from the digital decoding means (22). Thus, the transistor collector is pulled up to the dc supply voltage level via the transistor protective resistor (40). Accordingly, the AND logic gate is enabled. Hence, pulses from the 555 timer are sent to the base of transistor (42). Therefore, these pulses intermittently trigger the transistor. Thus, both of the buzzer (46) and the bulb (48) will be energized via transistor (42) and its protective resistor (44). This sends an audio and visual alerting signal to the person holding the receiver unit to remind him/her that an object/item/animal has been forgotten or left behind. Transistor (42) can also activate a message player or any other means as reminder to the person.
Figure 6:
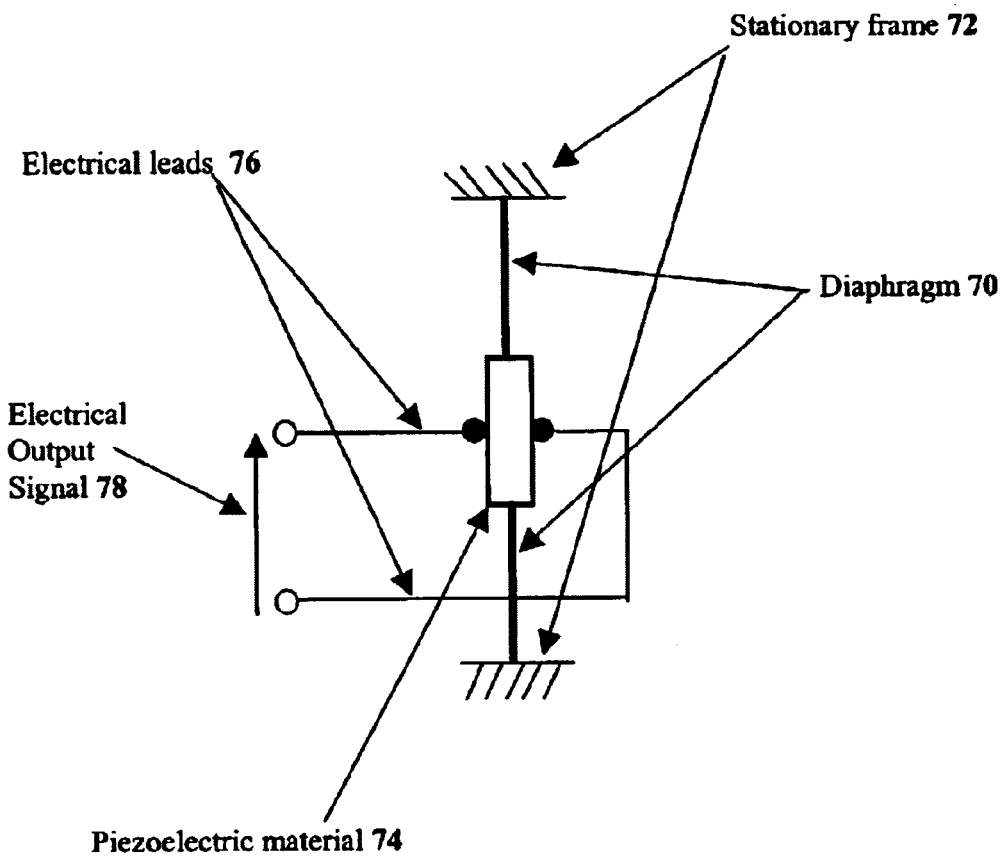
FIG. 6 shows the receiving means which could be a piezoelectric material or any other suitable material and energizing in response a sensor/s or singles to start alerting function and/or to perform any other desired response means. The communication media could be ultrasonic waves or any other suitable media. The receiving means consists of a diaphragm (70) fixed to a stationary frame (72). A small piece of piezoelectric material or any other suitable material is attached to this diaphragm (74). If the transmitted waves from the transmitter (5O) are of a sufficient strength, the diaphragm will start vibrating in sympathy with these waves. Hence the piezoelectric material or any other suitable material (74) will be subjected to a stress of enough value to generate a small electronic signal (78) across the two leads (74) that are connected to both sides of the piezoelectric material or any ocher suitable material.
Figure 7:
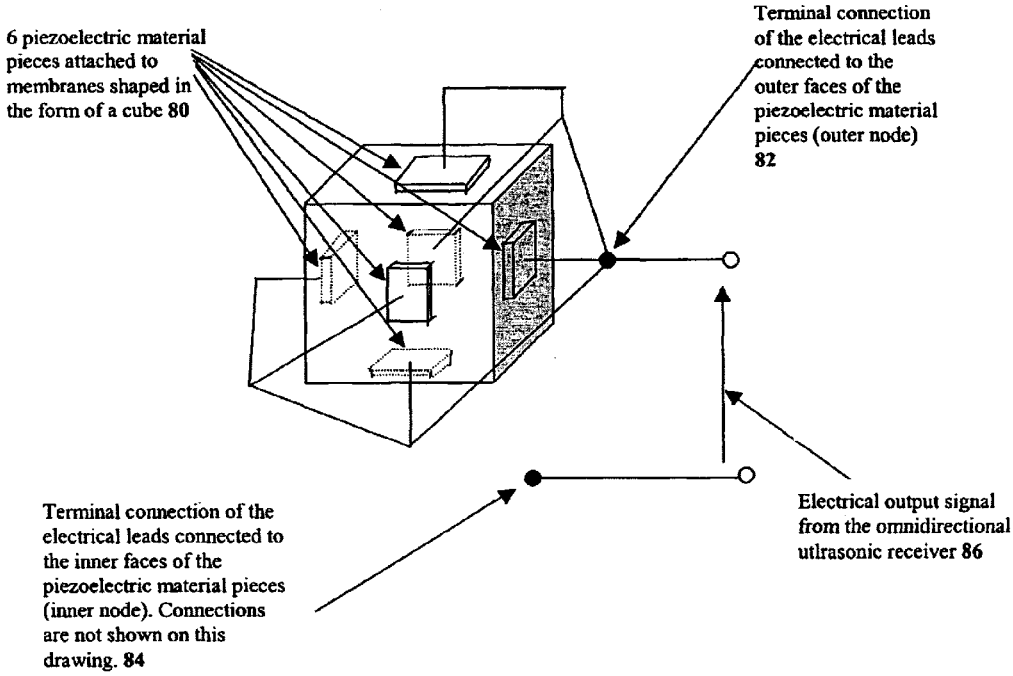
FIG. 7 shows an omni-directional receiving means which utilizes six of the configuration illustrated in FIG. 6. These six configurations are arranged on the face of a cube (80) or any other general structure. The outputs from the various pieces of the piezoelectric material or any other type of material used could be connected in parallel (82,84), thus, giving a single electrical output signal (86).

In the integrated receiver/reminder unit carried by a person, as long as the ultrasonic receiving means (14) is detecting the signal emanating from the transmitter that is attached to an object/item/animal, the reminder unit (24), FIG. 3 is disabled. As soon as the object/item/animal is out of the receiver/reminder unit range, the reminder unit (24) is enabled, thus providing an alerting means to the person. The ultrasonic receiving means is shown in detail in FIG. 6. As it can be seen, it consists of a diaphragm (70) fixed to a stationary frame (72). A small piece of a piezoelectric material is attached to this diaphragm (74). If the transmitted pressure waves from the piezoelectric transmitter (50) has a sufficient strength to vibrate the diaphragm, the piezoelectric material (74) will undergo a sufficient stress in order to generate a small electrical signal (78) across the two leads (74) that are connected to both sides of the piezoelectric material. The strength of this signal is function of the distance between the transmitter unit (attached to an object/item/animal) and the receiver/reminder unit (carried by a person) as well the strength and frequency of the transmitted signal from the piezoelectric transmitter (50). An omnidirectional ultrasonic receiving means is realized by arranging six of the configuration shown in FIG. 6 on the faces of a cube (80) as shown in FIG. 7. The outputs from the piezoelectric material pieces are connected in parallel (82, 84), thus giving one electrical signal output (86). The electrical signal (86) generated by the omnidirectional ultrasonic receiving means is fed to the demodulation unit (16), which is supplied with the carrier ultrasonic frequency signal ((10). The output signal from (16) is fed to the receiver amplifier means (18) and then to the FSK demodulation means (20). The output from (20) is fed to a digital decoder means (22) to decode the encoded signal. The output from (22) triggers the reminder means (24) when the transmitter unit is out of range of the receiver/reminder unit. The reminder means (24) provides the visual/audible alerting means to a person carrying the receiver/reminder unit to remind this person that an object/item/animal to which the transmitter unit is attached has been forgotten or left behind. The components comprising the receiver/reminder unit, FIG. 2, can be housed in a container/enclosure which is similar to the one used for the transmitter unit (64), FIG. 4, and this container/enclosure can be attached to a crocodile clip (66) which is similar to the one used for the transmitter unit, FIG. 5. The crocodile clip can then be clipped to the clothes of a person who needs to be reminded of an object/item/animal forgotten or left behind.

CONCLUSIONS, RAMIFICATIONS AND SCOPE

A simple, low cost and fit for purpose alerting security device intended to give alerting (audio and/or visual) facility as a reminder to a person that he/she has forgotten, left behind or separated a specified pre-set distance from an object/item/animal/person anywhere is described. The device consists of a transmitter unit and an integrated receiver/reminder unit. The transmitter unit is attached or clipped to the object/item/animal. The integrated receiver/reminder unit is carried by, attached to or clipped to the clothes of the person who needs to be reminded that he/she has forgotten or left behind an object/item/animal. The reminder unit within the integrated receiver/reminder unit is enabled (to give audio and/or visual warning) by the receiver unit, once the person has moved away within a specific short distance from the object/item/animal, thus alerting the person to go back and fetch the object/item/animal he/she ha forgotten or left behind.

Alternative means of the modulation and demodulation of the transmitted and the received signals respectively are possible ramification of this invention. This can affect the range; power supply consumed power, communication frequency and the shape, size and dimensions of the piezoelectric transmitter and receiver.

If the device described in this invention is used in different applications, for example warning a carer about straying children or mentally handicapped persons or if it is used under water or any other different media, alternative ingredients of the communication system presented may have to be used but these are considered within the scope of the applications of the present invention.

What is claimed is:

1. A new system and a new method for giving alerting facility as a reminder to a person that he/she has forgotten some object/item/luggage/animal behind anywhere or to secure that traveler is accompanying his/her checked luggage/objects and to quickly identify luggage that does not belong to traveler on board, comprising a transmitting means, which is attached or clipped to the object/item/luggage/animal and a portable receiving/alerting means, which is held or clipped to the clothes of the person, Said transmitting means including:

Power supply and on/off power switching means; line driver means to generate an n-bit unique encoded digital signal; frequency shift keying means which modulates the encoded signal such that a logic one in the said signal is represented by an audio signal at a specified frequency and a logic zero is represented by an audio signal at a different frequency; frequency modulation means where a carrier signal frequency is modulated by the frequency shift keying modulated digital signal; amplifying means to amplify the said signal prior to feeding it to the said frequency modulation means; signal transmission means for the transmission of the amplified modulated signal from the said frequency modulation means in the form of radio or pressure sound waves;

Said receiving/alerting means including:

Power supply on/off power switching means; signal receiving means for receiving the transmitted signal from said transmitting means; frequency demodulation means to demodulate the said transmitted signal; amplifying means which amplifies the demodulated signal outputted from the said frequency demodulation means; frequency shift keying demodulation means to demodulate the output signal from the said amplifying means; decoder means to decode the output signal from the said frequency shift keying demodulation means; alerting means which is enabled from the Said decoder means in order to generate an alert when the object/item/luggage/animal to which the said transmitting means is attached, is away from the said receiving/alerting means within a predetermined range.

2. The system of claim 1 wherein said alerting means implies audio or visual alerting means to alert a person that he/she has forgotten or left behind an object/item/luggage/animal anywhere.

3. The alerting means of claim 2 wherein said audio alerting means implies a buzzer, a message player, a piece of song or music player which start to buzz, play music/song a message in a specially recognized sound and wherein said visual alerting means implies bulb/lamp which starts to flash at a recognized frequency and color.

4. The system of claim 1 wherein the alerting means implies a telecommunication link, electronic messaging or any other remote messaging means.

5. The system of claim 1 wherein the said transmitting or receiving means comprises single or multi-dimensional ultrasonic transmitting or receiving device.

6. The device of claim 5 wherein said multi-dimensional ultrasonic transmitting or receiving device comprise two half piezoelectric spheres/ellipsoids placed in a housing to leave a small gap in the middle which provides a route for connection of suitably shielded leads to both of the inner and outer surfaces of the two half spheres/ellipsoids to the alerting means of the transmitting/receiving means.

7. The device of claim 5 wherein said multi-dimensional ultrasonic transmitting or receiving devices comprises piezoelectric materials arranged in other geometric configurations such as cubical, octagon or hexagon where by an ultrasonic signal or pressure sound waves can be radiated an all directions.

8. The device of claim 5 wherein he said multi-dimensional ultrasonic transmitting or receiving means comprises multi pieces of piezoelectric material attached to membranes which are substantially arranged, in the form of a cube whereas the edges of the cube are made of rigid fixtures, all the outer surfaces of the piezoelectric pieces of material are joined together via electrical conducting leads to form an outer node and all of the inner surfaces are joined together via conducting leads to form an inner node and both of the outer node and inner nodes will be connected to the transmitted or received signal.

9. The system of claim 1 wherein said alerting means comprises an oscillator or a pulse generator, logic device/devices, analog device/devices and passive circuit components.

10. The alerting means of claim 1 be integrated to the receiving, transmitting or can be a stand alone device.

11. The alerting means of claim 1 can automatically reset itself once a person goes back to fetch a forgotten or left behind object/item/luggage/animal or a luggage has been retrieved and secured.

12. The system of claim 1 wherein said frequency keying means logic 1 is represented by an audio signal frequency about 1800 Hz and logic zero is represented by an audio signal of a frequency of about 1200 Hz.

13. The system of claim 1 wherein said frequency modulation means the carrier frequency is ultrasonic of about 20–40 KHz.

14. The system of claim 1 wherein said transmitting or receiving means comprises a directional antenna.

15. The system of claim 14 wherein said directional antenna is mounted on a rotating means to facilitate the search for an item/object/luggage/animal.

16. The system of claim 15 wherein said rotating means is an electric motor.

17. The system of claim 16 wherein said electric motor is a small flat structure direct current motor with printed circuit board armature to minimize power consumption.

18. The system of claim 15 wherein said electric motor means include an open or closed loop electronic circuit means for the motor shaft position.

19. A new system and a new method for giving alerting facility as a reminder to a person that he/she has forgotten some object/item/luggage/animal behind anywhere and/or to secure that traveler is accompanying his/her checked luggage/objects and to quickly identify luggage that does nor belong to traveler on board or other applications alerts in response to a signal or a sensor, comprising a transmitting means, which is attached or clipped to the object/item/luggage/animal and a portable receiving/alerting means, which is held or clipped to the clothes of the person.

Said transmitting means including:

Power supply and on/off power switching means in response to a signal or a sensor; line driver means to generate an n-bit unique encoded digital signal; frequency shift keying means which modulates the encoded signal such that a logic one in the said signal is represented by an audio signal at a specified frequency and a logic zero is represented by an audio signal at a different frequency; amplification to amplify the said signal prior to feeding it to the said frequency modulation means; signal transmission means for the transmission of the amplified signal in the form of radio or pressure sound waves;

Said receiving/alerting means including:

Power supply and on/off power switching means; signal receiving means for receiving the transmitted signal from said transmitting means; amplifying means which amplifies the received signal; frequency shift keying demodulation means to demodulate the output signal from the said amplifying means; decoder means to decode the output signal from the said frequency shift keying demodulation means; alerting means which is enabled from the said decoder means in order to generate an alert when the object/item/luggage/animal to which the said transmitting means is attached, is away from the receiving/alerting means within a predetermined range.

20. A new system and methodology for giving alerting facility as a reminder to a person that he/she has forgotten some object/item/luggage/animal behind anywhere or to secure that traveler is accompanying his/her checked luggage/objects and to quickly identify luggage that does not belong to travelers on board that utilizes a multi-dimensional ultrasonic transmitting and receiving means comprising piezoelectric system arrange in a spherical, cubical, octagonal or hexagonal configurations to transmit or receive pressure sound waves in all directions;

Said transmitting means transmits an electrical signal in the form of sound waves whereby the electrical signal can be encoded, modulated or un-modulated;

Said receiving means receives pressure sound waves propagating through the air and generates an electrical signal which is proportional to these waves;

Said multi-dimentional piezoelectric system can convert electrical signal/signals to multi-dimensional motion.

* * * * *